US007519517B2

(12) United States Patent
Kakishita et al.

(10) Patent No.: US 7,519,517 B2
(45) Date of Patent: Apr. 14, 2009

(54) BLADE SHAPE CREATION PROGRAM AND METHOD

(75) Inventors: Naoya Kakishita, Tokyo (JP); Itsuhei Kori, Tokyo (JP)

(73) Assignee: Mitsubishi Fuso Truck and Bus Corporation (JP)

( * ) Notice: Subject to any disclaimer, the term of this patent is extended or adjusted under 35 U.S.C. 154(b) by 752 days.

(21) Appl. No.: 11/093,021

(22) Filed: Mar. 29, 2005

(65) Prior Publication Data

US 2005/0249600 A1 Nov. 10, 2005

(30) Foreign Application Priority Data

Mar. 30, 2004 (JP) ..... 2004-099029

(51) Int. Cl.
*G06F 17/50* (2006.01)
*G06F 7/60* (2006.01)
*G06F 17/10* (2006.01)
*F04B 17/00* (2006.01)

(52) U.S. Cl. ..... 703/1; 417/423.1; 417/423.7; 703/2

(58) Field of Classification Search ..... 703/1, 703/2; 415/208.1, 208.2; 416/223 R, 243; 417/423.1, 423.7
See application file for complete search history.

(56) References Cited

U.S. PATENT DOCUMENTS 5,717,905 A * 2/1998 Iwamoto et al. ..... 703/1
6,129,528 A * 10/2000 Bradbury et al. ..... 417/423.1
6,558,123 B1 * 5/2003 Spaggiari ..... 416/238
2004/0208746 A1 10/2004 Crocker
2005/0008069 A1 1/2005 Cao
2005/0232778 A1 10/2005 Kakishita et al.

OTHER PUBLICATIONS

Specification and claims of related co-pending U.S. Appl. No. 11/092,132.
T. Fujimoto, "2nd Revision of Fluid Dynamics", 2nd Revision, 6th Edition, Yokendo Co., Ltd., published Jan. 20, 1992, p. 141, p. 2, lines 8-20. Relevancy explained in Specification of present application; p. 2; lines 8-20.
Richard S. Shevell; Fundamentals of Flight, second edition, 1989, Prentice-Hall, pp. 2180-0220. Cited in Office Action of related co-pending application US 20050232778.

(Continued)

*Primary Examiner*—Paul L Rodriguez
*Assistant Examiner*—Dwin M Craig
(74) *Attorney, Agent, or Firm*—Rossi, Kimms & McDowell LLP

(57) ABSTRACT

In a blade shape creation program and method, a camber line defining equation for defining a camber line to be defined on a cross section of a blade shape is constructed by a cubic function as a first function defining a leading edge camber line on a leading edge side of a maximum camber point on the camber line, and a cubic function as a second function defining a trailing edge camber line on a trailing edge side of the maximum camber point on the camber line; is defined, with a chord length, a position of maximum camber, a maximum camber value, an inflow angle, and a discharge angle of the camber line being taken as design factors; and has the boundary condition that the first function and the second function have tangents continuous with each other at the maximum camber point.

10 Claims, 9 Drawing Sheets

OTHER PUBLICATIONS

Steven C. McConnell, "Code Complete: a practical handbook of software construction", 1993, Microsoft Press, pp. 602-604. Cited in Office Action of related to co-pending application US 20050232778.

Ed Lee, "User-Interface Development Tools", May 1990, IEEE Software, vol. 7, issue 3, pp. 31-36. Cited in Office Action of related co-pending application US 20050232778.

Peter Lancaster et al.; "Curve and Surface Fitting An Introduction", 1986, Academic Press, pp. 67 and 76-78. Cited in Office Action of related co-pending application US 20050232778.

K.C. Giannakoglu, "Design of optimal aerodynamic shapes using stochastic optimization methods and computational intelligence", 2002, Progress in Aerospace Sciences, vol. 38, pp. 43-76. Cited in Office Action of related co-pending application US 20050232778.

* cited by examiner

| | Error-1 | Error-2 | Error-3 | Error-4 |
|---|---|---|---|---|
| Curve-1 | ○ | ○ | ○ | ○ |
| Curve-2 | warning | ○ | ○ | ○ |
| Curve-3 | ○ | warning | caution | caution |

Close

16

42

BLADE SHAPE CREATION PROGRAM AND METHOD

CROSS REFERENCE TO RELATED APPLICATION

The entire disclosure of Japanese Patent Application No. 2004-099029 filed on Mar. 30, 2004, including specification, claims, drawings and summary, is incorporated herein by reference in its entirety.

BACKGROUND OF THE INVENTION

1. Field of the Invention

This invention relates to a blade shape creation program and method for creating the blade shape of a cooling fan.

2. Description of the Related Art

When the blade shape of a cooling fan installed in a vehicle is to be created (drawn) in designing the cooling fan, for example, the first step is to create (draw) the cross-sectional shapes of a blade at a plurality of locations in the hub diameter direction of the blade. Then, based on these cross-sectional shapes of the blade, the entire shape of the blade (visible outline and exterior surface) is created (drawn) by spline interpolation or the like. In drawing the cross-sectional shape of the blade, "average camber curve (camber line)", which is a basic skeleton of the cross-sectional shape of the blade, is drawn. A method using "Joukowski airfoil" shown, for example, in the following document is named as one of ordinary methods for drawing the camber line:

T. Fujimoto, "2nd Revision of Fluid Dynamics", 2nd Revision, 6th Edition, YOKENDO Co., Ltd., published Jan. 20, 1992, p. 141"

An outline of this method will be described with reference to FIGS. 10(*a*) and 10(*b*). A combination of two circles 1 and 2 with centers M and M', as shown in FIG. 10(*a*) , is transformed into coordinates (mapped) by the equation (1) offered below. An airfoil (cross-sectional shape of blade) 3 as shown in FIG. 10(*b*), which is obtained by this coordinate transformation (mapping), is the "Joukowski airfoil". A centerline of this airfoil (cross-sectional shape of blade) 3 is a camber line 4. To change the airfoil profile (camber line), the shapes of the two circles 1 and 2 before coordinate transformation are adjusted.

$$z = \zeta + \frac{a^2}{\zeta},\ a = \frac{c}{4} \tag{1}$$

To improve the performance of the blade (lift performance and drag performance), it is necessary to change (adjust) the shape of the camber line and study influence on the performance of the blade. For this purpose, it is effective to individually change (adjust) a plurality of design factors (details to be described later), which determine the shape of the camber line, thereby directly investigating the degree of contribution of each design factor to the performance of the blade. Particularly, the ability to change each design factor, independently of each other, on the leading edge side of the maximum camber point of the camber line (see FIG. 3, details to be described later) and on the trailing edge side of the maximum camber point would be very effective for studying the performance of the blade.

However, conventional methods, such as the method using "Joukowski airfoil", pose difficulty in changing each design factor independently. Needless to say, changing each design factor, independently on the leading edge side and the trailing edge side of the camber line, is also difficult.

The present invention has been accomplished in light of the above-described circumstances. It is an object of the present invention to provide a blade shape creation program and method capable of changing a plurality of design factors, which determine the shape of a camber line, on the leading edge side and the trailing edge side of the camber line, with the leading edge side and the trailing edge side being separated from each other, in changing (adjusting) the shape of the camber line.

It is another object of the present invention to provide a blade shape creation program and method capable of reliably checking the created camber line shape based on numerical values, without relying on visual checks.

SUMMARY OF THE INVENTION

A first aspect of the present invention, for attaining the above object, is a blade shape creation program for creating a blade shape on a space virtually defined by a computer, wherein a camber line defining equation for defining a camber line to be defined on a cross section of the blade shape is constructed by a first function which defines a leading edge camber line on a leading edge side of a maximum camber point on the camber line, and a second function which defines a trailing edge camber line on a trailing edge side of the maximum camber point on the camber line.

A second aspect of the present invention is the blade shape creation program according to the first aspect, wherein the camber line defining equation has the first function and the second function each defined by a cubic function, is defined, with a chord length, a position of maximum camber, a maximum camber value, an inflow angle, and a discharge angle of the camber line being taken as design factors, and has a boundary condition that the first function and the second function have tangents continuous with each other at the maximum camber point.

A third aspect of the present invention is a blade shape creation method for creating a blade shape on a virtually defined space, wherein a camber line defining equation for defining a camber line to be defined on a cross section of the blade shape is constructed by a first function which defines a leading edge camber line on a leading edge side of a maximum camber point on the camber line, and a second function which defines a trailing edge camber line on a trailing edge side of the maximum camber point on the camber line.

A fourth aspect of the present invention is the blade shape creation method according to the third aspect, wherein the camber line defining equation has the first function and the second function each defined by a cubic function, is defined, with a chord length, a position of maximum camber, a maximum camber value, an inflow angle, and a discharge angle of the camber line being taken as design factors, and has a boundary condition that the first function and the second function have tangents continuous with each other at the maximum camber point.

BRIEF DESCRIPTION OF THE DRAWINGS

The present invention will become more fully understood from the detailed description given herein below and the accompanying drawings which are given by way of illustration only, and thus are not limitative of the present invention, and wherein.

DESCRIPTION OF THE PREFERRED EMBODIMENTS

Embodiments of the present invention will now be described in detail with reference to the accompanying drawings. The application of a blade shape creation program according to the present invention to the creation of the blade shape of a cooling fan will be taken as an example for explanation.

Figure 1:
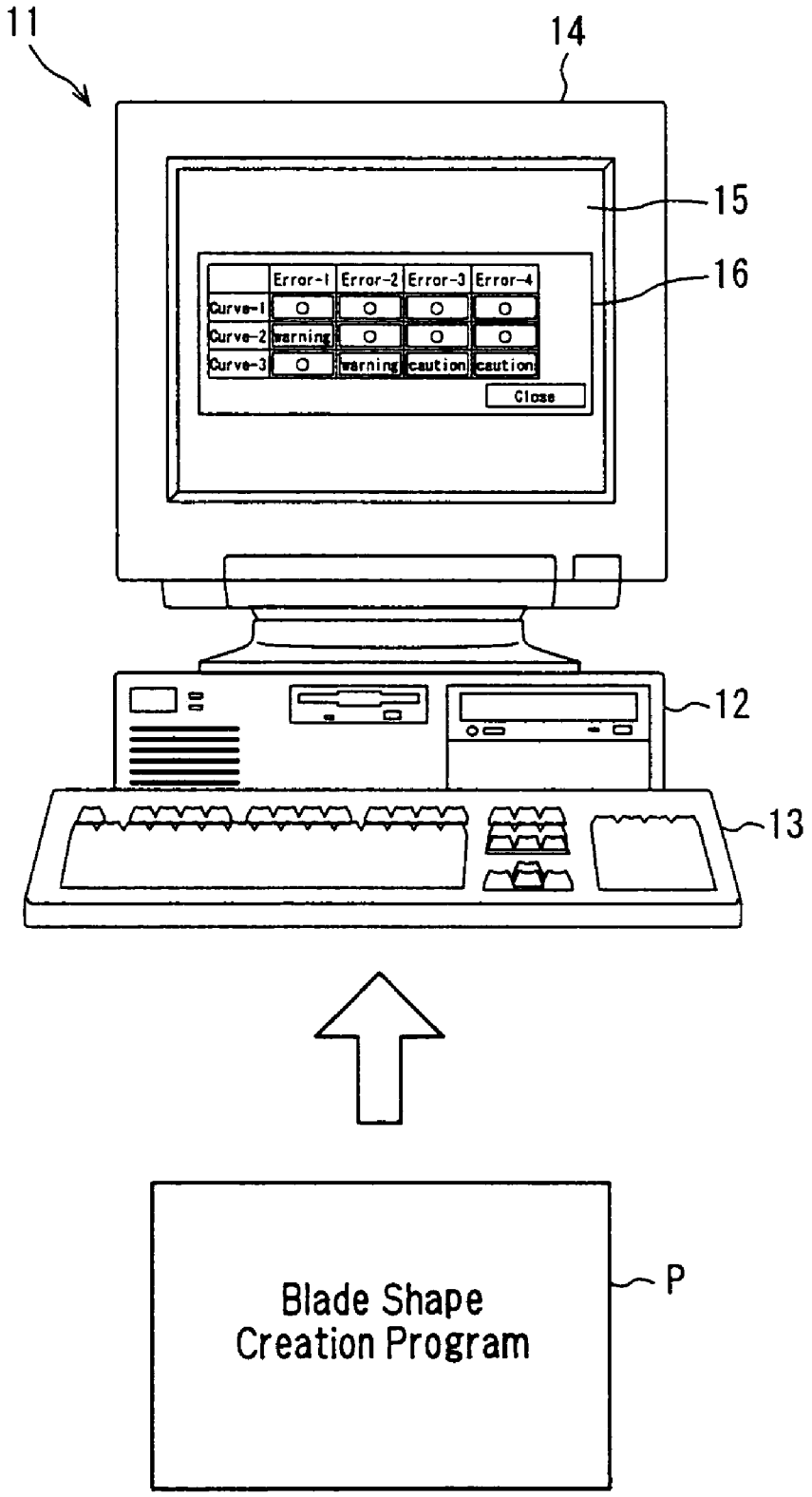
FIG. 1 is an external outline view of a personal computer for executing a blade shape creation program according to an embodiment of the present invention.
Figure 2B:
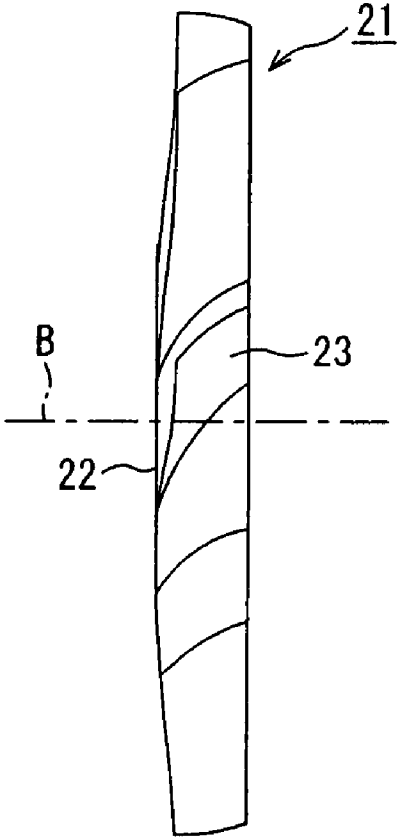
FIG. 2B is a side view of the cooling fan (a view taken in the direction of A in FIG. 2A)
Figure 2A:
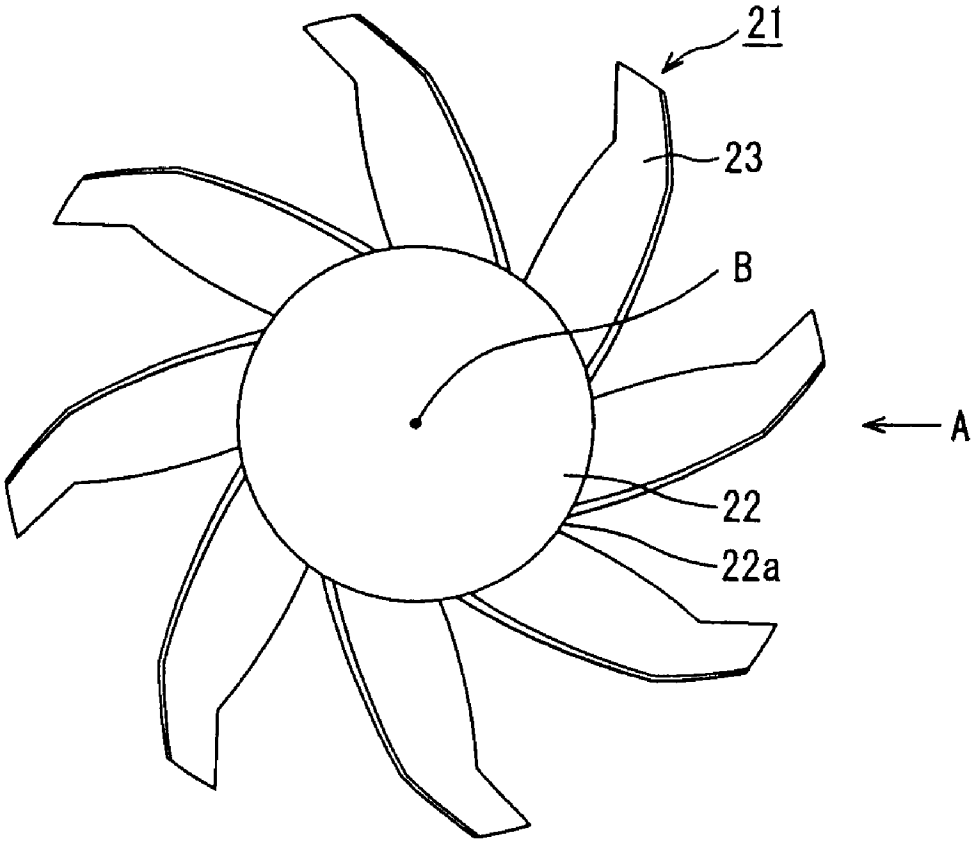
FIG. 2A is a front view of a cooling fan.

FIG. 1 is an external outline view of a personal computer for executing a blade shape creation program according to an embodiment of the present invention. FIG. 2A is a front view of a cooling fan, and FIG. 2B is a side view of the cooling fan (a view taken in the direction of A in FIG. 2A).

As shown in FIG. 1, a personal computer 11 has a computer body 12, and peripheral instruments connected to the computer body 12, such as a keyboard 13 as an input means, and a display device 14 as a display means, for example, a CRT or a liquid crystal display.

The computer body 12 is equipped with a CPU, a hard disk (HD) drive, and a compact disk (CD) drive, and the CPU executes a blade shape creation program P (software) stored in storage media such as HD and CD. The blade shape creation program P is a program for creating a blade shape on a space virtually defined by the personal computer 11. This program can change a plurality of design factors, which determine the shape of a camber line, independently of each other, in changing the shape of the camber line, although details of the program will be described later.

The keyboard 13 is used to enter data for execution of the blade shape creation program P into the computer body 12. The display device 14 is used for displaying on a display screen 15 the data entered from the keyboard 13 into the computer body 12, and the results of execution of the blade shape creation program P in the computer body 12. For example, the display device 14 displays a checklist window 16 (details to be described later).

FIGS. 2A and 2B show an example of a cooling fan loaded on a vehicle. A cooling fan 21 illustrated in FIGS. 2A and 2B comprises a plurality of (eight in the illustrate example) blades 23 provided on an outer peripheral surface 22*a* of a cylindrical hub 22. The cooling fan 21 has a rotating shaft (not shown) connected, for example, to a rotating shaft of an engine of the vehicle, and rotationally driven thereby. In the side view of FIG. 2B, each blade 23 is provided on the outer peripheral surface 22*a* of the hub such that its chord is inclined at a predetermined blade inclination angle with respect to a hub center axis B (see FIG. 7). The exterior shape of the blade 23 is not limited to the illustrated one, but is available in various types.

In creating (drawing) the blade shape of each blade 23 of the cooling fan 21 for designing the cooling fan 21, the present embodiment is arranged to create (draw) a camber line by executing the blade shape creation program P on the personal computer 11.

The camber line creation function (program), camber line checking function (program), and checklist window display function (program) of the blade shape creation program P will be described in detail based on FIGS. 3 to 9A, 9B.

Figure 3:
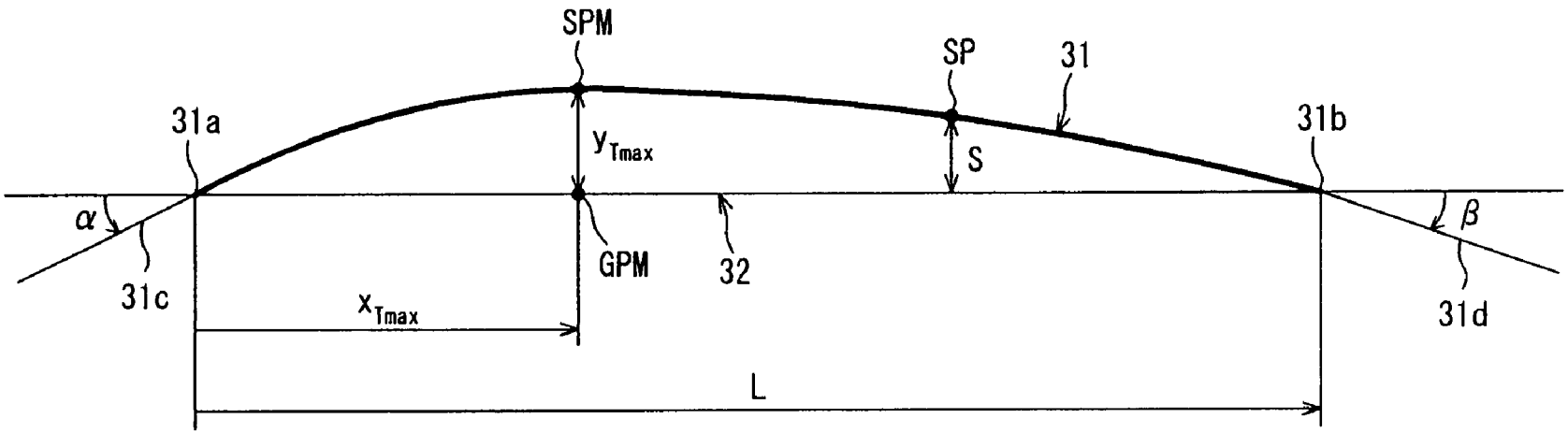
FIG. 3 is an explanation drawing of design factors for determining the shape of a camber line.
Figure 4:
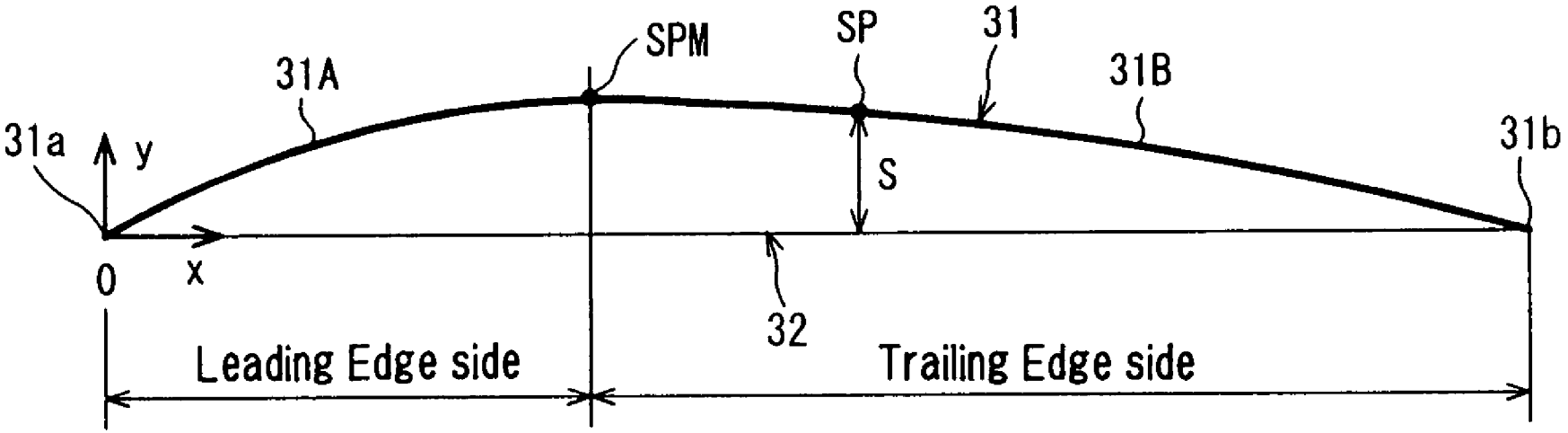
FIG. 4 is a view showing a coordinate system (camber line drawing method) used when drawing the camber line by a cubic function.
Figure 5:
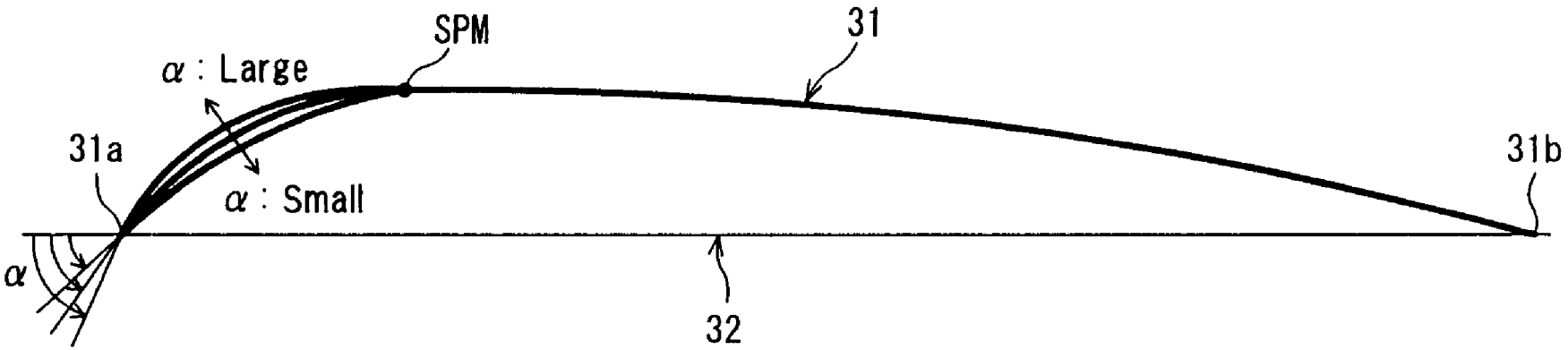
FIG. 5 is a view showing an example of drawing the camber line when only an inflow angle is changed.
Figure 6A:
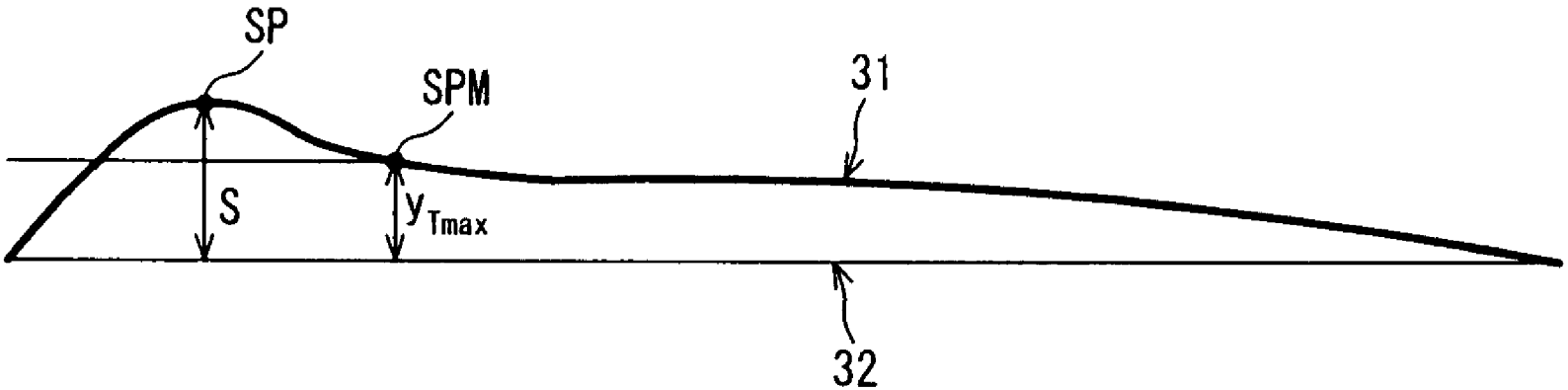
FIG. 6A is a view showing an example of drawing a camber line on which the camber value of a camber point other than a set maximum camber point is greater than the maximum camber value of the maximum camber point.
Figure 6B:
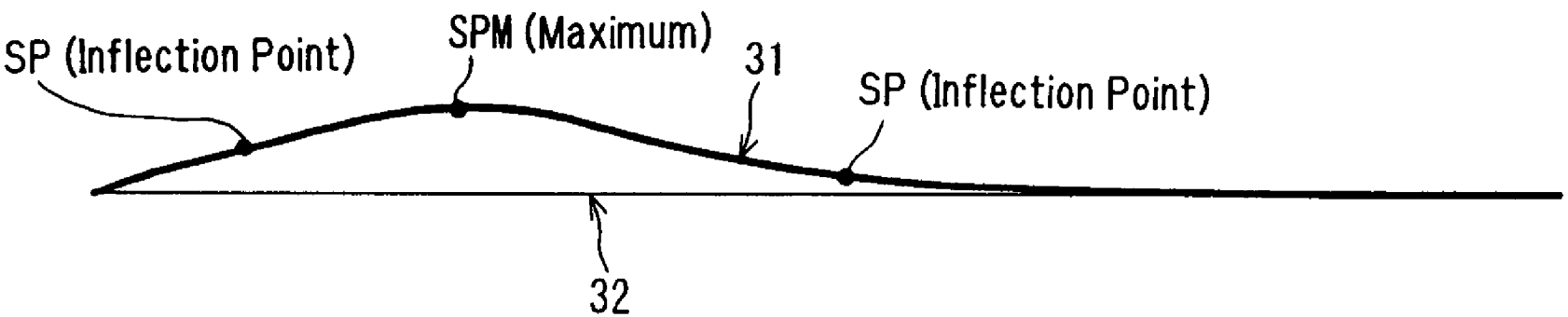
FIG. 6B is a view showing an example of drawing a camber line which has inflection points at camber points other than a set maximum camber point.
Figures 7, 8:
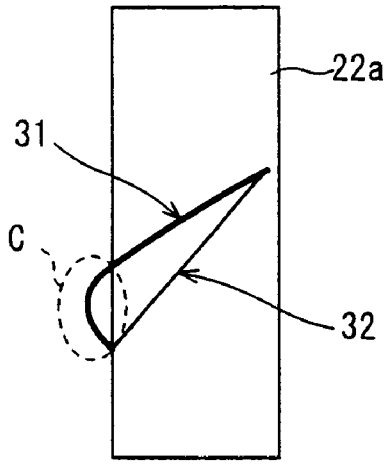
FIG. 7 is a view showing an example in which a camber line extends beyond a hub.
FIG. 8 is a view showing an example of a checklist window.
Figure 9A:
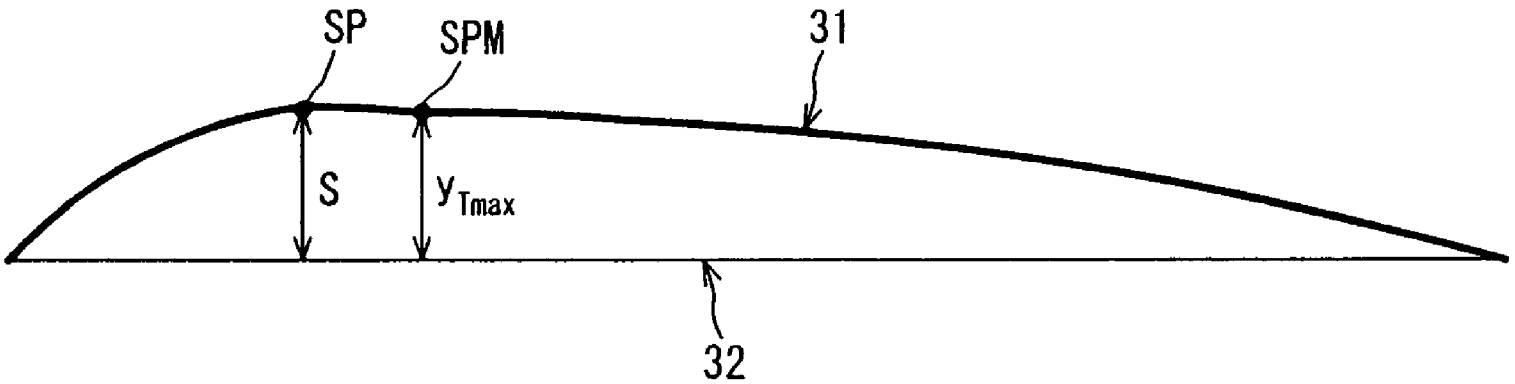
FIG. 9A is a view showing an example of drawing a camber line of a delicate shape in which the camber value of a camber point other than a set maximum camber point is slightly greater than the maximum camber value of the maximum camber point.
Figure 9B:
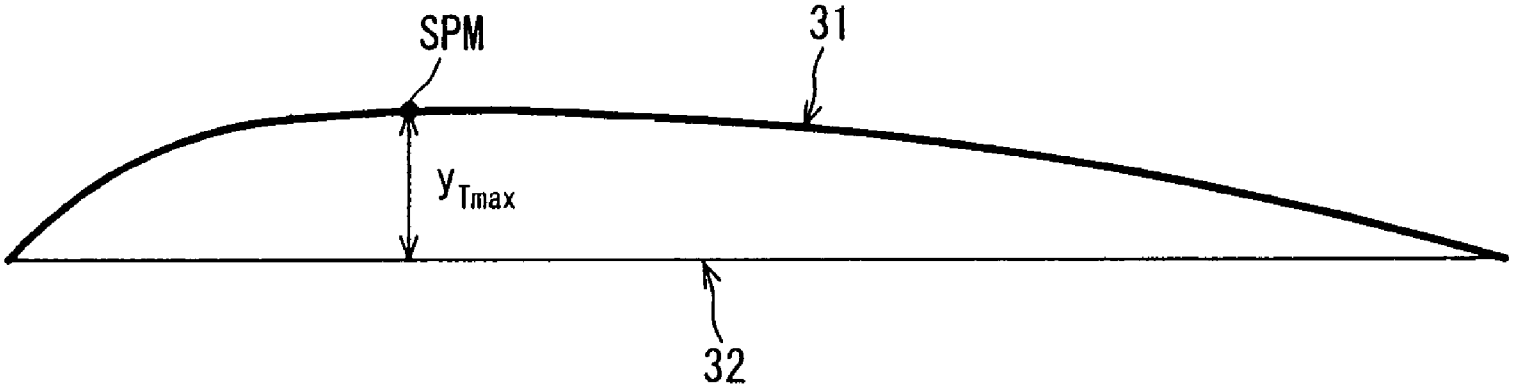
FIG. 9B is a view showing an example of drawing a camber line of a shape in which there is no problem in a maximum camber value.

FIG. 3 is an explanation drawing of design factors for determining the shape of a camber line. FIG. 4 is a view showing a coordinate system (camber line drawing method) used when drawing the camber line by a cubic function. FIG. 5 is a view showing an example of drawing the camber line when only an inflow angle is changed. FIG. 6A is a view showing an example of drawing a camber line on which the camber value of a camber point other than a set maximum camber point is greater than the maximum camber value of the maximum camber point. FIG. 6B is a view showing an example of drawing a camber line which has inflection points at camber points other than a set maximum camber point. FIG. 7 is a view showing an example in which a camber line extends beyond a hub. FIG. 8 is a view showing an example of a checklist window. FIG. 9A is a view showing an example of drawing a camber line of a delicate shape in which the camber value of a camber point other than a set maximum camber point is slightly greater than the maximum camber value of the maximum camber point. FIG. 9B is a view showing an example of drawing a camber line of a shape in which there is no problem in a maximum camber value.

The camber line creation function of the blade shape creation program P will be described first of all.

In providing the camber line creation (drawing) function, the following five design factors (1) to (5) were selected as optimal (basic) design factors for determining the shape of a camber line (see FIG. 3):

(1) Chord length L (2) Position of maximum camber $X_{Tmax}$ (3) Maximum camber value $Y_{Tmax}$ (4) Inflow angle $\alpha$ (5) Discharge angle $\beta$ As shown in FIG. 3, the chord length L refers to the length of a chord 32 which is a straight line connecting the leading edge 31*a* of a camber line 31 (i.e., the leading edge of a blade section) and the trailing edge 31*b* of the camber line (i.e., the trailing edge of the blade section) (i.e., the chord length is the rectilinear distance between the leading edge and the trailing edge) The leading edge 31*a* of the camber line 31 is a site where airflow enters, while the trailing edge 31*b* of the camber line 31 is a site where airflow exits. Each point (position) on the camber line 31 is called a camber point SP. The distance between the chord 32 and the camber line 31 at each camber point SP on the camber line 31 (i.e., the length of a perpendicular dropped from each camber point SP to the chord 32) is called a camber value S. The maximum of the camber value S is called a maximum camber value $y_{Tmax}$. The camber point SP that presents the maximum camber value $y_{Tmax}$ is called a maximum camber point SPM. Let an intersection point of the chord 32 and a perpendicular dropped from the maximum camber point SPM to the chord 32 be GPM. Then, the position of maximum camber $x_{Tmax}$ is at a distance in a straight line from the leading edge 31*a* to the intersection point GPM. The inflow angle α is an angle which a tangent 31*c* to the leading edge 31*a* of the camber line 31 makes with the chord 32. The discharge angle β is an angle which a tangent 31*d* to the trailing edge 31*b* of the camber line 31 makes with the chord 32.

A camber line defining equation for defining a camber line to be defined on the cross section of a blade shape is constructed by a first function which defines a leading edge camber line on the leading edge side of the maximum camber point SPM on the camber line 31, and a second function which defines a trailing edge camber line on the trailing edge side of the maximum camber point SPM on the camber line 31. That is, as shown in FIG. 4, the camber line 31 is divided into a leading edge side line and a trailing edge side line, with the maximum camber point SPM as a boundary. A cubic function of an equation (2) is selected as a first function which defines (represents) a leading edge camber line 31A on the leading edge side of the maximum camber point SPM, and a cubic function of an equation (3) is selected as a second function which defines (represents) a trailing edge camber line 31B on the trailing edge side of the maximum camber point SPM. To express the shape of the camber line 31 by an xy coordinate system, the leading edge 31*a* of the camber line 31 is taken as the origin of the xy coordinate system, the coordinate axis in the chord length direction (direction along the chord 32) is designated as an x-axis, and the coordinate axis in the camber direction (direction perpendicular to the chord 32) is designated as a y-axis.

$$y_L=a_Lx_L^3+b_Lx_L^2+c_Lx_L+d_L \tag{2}$$

$$y_T=a_Tx_T^3+b_Tx_T^2+c_Tx_T+d_T \tag{3}$$

The reason for selecting the cubic functions as the first function and the second function is that the aforementioned five design factors are selected as the optimal design factors determining the shape of the camber line 31, whereby the eight constraints (1) to (8) to be indicated below can be set based on these design factors. That is, of the eight constraints (1) to (8), the four constrains (1), (3), (5) and (7) can be set for the leading edge side of the camber line 31, while the other four constrains (2), (4), (6) and (8) can be set for the trailing edge side of the camber line 31. In accordance with these constraints, therefore, the respective coefficients ($a_L$, $b_L$, $c_L$, $d_L$, $a_T$, $b_T$, $c_T$, $d_T$) of the cubic functions of the equations (2) and (3) can all be uniquely determined by these constraints. The constrains (1) to (4) are the constraints concerned with the shunts of the camber line 31, while the constraints (5) to (8) are the constraints about the gradient of the tangents at the shunts of the camber line 31.

If the number of the design factors (constraints) is small, quadratic functions may be used as the first and second functions. If the number of the design factors (constraints) is large, functions of fourth or higher order may be used. However, if the number of the design factors (constraints) is too small, sufficient adjustment of a camber line shape cannot be made. Too large a number of the design factors (constraints) would wastefully render an equation of the function complicated. Thus, it would be best to select, as the first function and the second function, cubic functions which are suitable for the five design factors (chord length L, position of maximum camber $x_{Tmax}$, maximum camber value $y_{Tmax}$, inflow angle α, discharge angle β) optimal as design factors for determining the shape of the camber line 31.

(1) When $x_L=0$, $y_L=0$: Leading edge position
(2) When $x_T=L$, $y_T=0$: Trailing edge position (chord length)
(3) When $x_L=x_{Tmax}$, $y_L=y_{Tmax}$: Position of maximum camber, maximum camber value
(4) When $x_T=x_{Tmax}$, $y_T=y_{Tmax}$: Position of maximum camber, maximum camber value
(5) When $x_L=0$, $dy_L/dx_L=\tan\alpha$: Inflow angle
(6) When $x_T=L$, $dy_T/dx_T=\tan(-\beta)$ : Discharge angle
(7) When $x_L=x_{Tmax}$, $dy_L/dx_L=0$: Position of maximum camber (gradient of tangent)
(8) When $x_T=x_{Tmax}$, $dy_T/dx_T=0$: Position of maximum camber (gradient of tangent)

The constraint (1) is a constraint on the leading edge position of the camber line 31 for the equation (2). When $x_L=0$, namely, at the position of the leading edge 31*a* of the camber line 31, the camber value $y_L=0$. The constraint (2) is a constraint on the trailing edge position (chord length L) of the camber line 31 for the equation (3). When $x_T=L$ (chord length), namely, at the position of the trailing edge 31*b* of the camber line 31, the camber value $y_T=0$. The constraint (3) is a constraint on the position of maximum camber $x_{Tmax}$ and the maximum camber value $y_{Tmax}$ of the camber line 31 for the equation (2). The constraint (4) is a constraint on the position of maximum camber $x_{Tmax}$ and the maximum camber value $y_{Tmax}$ of the camber line 31 for the equation (3). The constraint (5) is a constraint on the inflow angle α of the camber line 31 for the equation (2), namely, a constraint on the gradient of the tangent at the position of the leading edge 31*a* of the camber line 31. The constraint (6) is a constraint on the discharge angle β of the camber line 31 for the equation (3), namely, a constraint on the gradient of the tangent at the position of the trailing edge 31*b* of the camber line 31.

The constraint (7) is a constraint on the gradient of the tangent at the position of maximum camber $x_{Tmax}$, i.e., at the maximum camber point SPM on the camber line 31, for the equation (2). The constraint (8) is a constraint on the gradient of the tangent at the position of maximum camber $x_{Tmax}$, i.e., at the maximum camber point SPM on the camber line 31, for the equation (3). Under the constrains (7) and (8), the gradient of the tangent at the position of maximum camber $x_{Tmax}$ (maximum camber point SPM) is zero, i.e., $dy_L/dx_L=0$. This is because unless the gradient of the tangent at the position of maximum camber $x_{Tmax}$ (maximum camber point SPM) is zero, the camber value S ($y_L$, $y_T$) at the set maximum camber point SPM is not maximal. The constrains (7) and (8) also mean that the maximum camber value at the maximum camber point SPM (position of maximum camber $x_{Tmax}$) is similarly $y_{Tmax}$, and the gradient of the tangent ($dy_L/dx_L$, $dy_T/dx_T$) is similarly zero, showing that the equation (2) of the first function and the equation (3) of the second function have the boundary condition that the tangents are continuous at the maximum camber point SPM.

Based on the above constraints (1) to (8), the respective design factors (chord length L, position of maximum camber $x_{Tmax}$, maximum camber value $y_{Tmax}$, inflow angle α, discharge angle β) are set (changed) independently of each other to find the respective coefficients ($a_L$, $b_L$, $c_L$, $d_L$, $a_T$, $b_T$, $c_T$, $d_T$) of the cubic functions of the equations (2) and (3). By so doing, the leading edge camber line 31A can be defined (drawn) based on the cubic function of the equation (2), and the trailing edge camber line 31B can be defined (drawn)

based on the cubic function of the equation (3). By combining the cubic functions of the equations (2) and (3), the whole of the camber line 31 can be defined (drawn).

The relationships between the respective coefficients ($a_L$, $b_L$, $c_L$, $d_L$, $a_T$, $b_T$, $c_T$, $d_T$) of the cubic functions of the equations (2) and (3) and the respective design factors (chord length L, position of maximum camber $x_{Tmax}$, maximum camber value $y_{Tmax}$, inflow angle $\alpha$, discharge angle $\beta$) are as indicated by the equations (4) to (11) offered below. To avoid the complexity of the indications of the equations, the equations (9), (10) and (11) for $b_T$, $c_T$ and $d_T$ include $a_T$. However, since $a_T$ is a function involving only the design factors as in the equation (8), $b_T$, $c_T$ and $d_T$ can also be regarded as functions composed of the design factors alone.

As the following equations (4) to (7) show, the respective coefficients ($a_L$, $b_L$, $c_L$, $d_L$) of the equation (2) for the cubic function on the leading edge side can be uniquely determined by determining the position of maximum camber $x_{Tmax}$, maximum camber value $y_{Tmax}$ and inflow angle $\alpha$ as the design factors. As the following equations (8) to (11) show, the respective coefficients ($a_T$, $b_T$, $c_T$, $d_T$) of the equation (3) for the cubic function on the trailing edge side can be uniquely determined by determining the chord length L, position of maximum camber $x_{Tmax}$, maximum camber value $y_{Tmax}$ and discharge angle $\beta$ as the design factors. The procedure for deriving the following relational expressions (4) to (11) will be described later.

$$a_L = \frac{-2y_{T\max} + x_{T\max}\cdot\tan\alpha}{x_{T\max}^3} \tag{4}$$

$$b_L = \frac{y_{T\max}}{x_{T\max}^2} - \frac{\tan\alpha}{x_{T\max}} - x_{T\max}\left(\frac{-2y_{T\max} + x_{T\max}\cdot\tan\alpha}{x_{T\max}^3}\right) \tag{5}$$

$$c_L = \tan\alpha \tag{6}$$

$$d_L = 0 \tag{7}$$

$$a_T = -\frac{(L - x_{T\max})\cdot\tan(-\beta) + 2y_{T\max}}{(x_{T\max} - L)^3} \tag{8}$$

$$b_T = -\frac{3}{2}(L + x_{T\max})\cdot a_T + \frac{\tan(-\beta)}{2(L - x_{T\max})} \tag{9}$$

$$c_T = a_T\cdot\left(\frac{1}{2}L^2 + 2L\cdot x_{T\max} + \frac{1}{2}x_{T\max}^2\right) - \frac{1}{L - x_{T\max}}\left(\frac{(L + x_{T\max})\cdot\tan(-\beta)}{2} + y_{T\max}\right) \tag{10}$$

$$d_T = \frac{1}{6}(x_{T\max}^3 - 2x_{T\max}\cdot L^2 - 5x_{T\max}^2\cdot L)\cdot a_T + \frac{x_{T\max}}{x_{T\max} - L}\left(\frac{x_{T\max}\cdot\tan(-\beta)}{6} - \frac{2}{3}\left(\frac{(L + x_{T\max})\cdot\tan(-\beta)}{2} + y_{T\max}\right) + \frac{x_{T\max} - L}{x_{T\max}}y_{T\max}\right) \tag{11}$$

Figure 10:
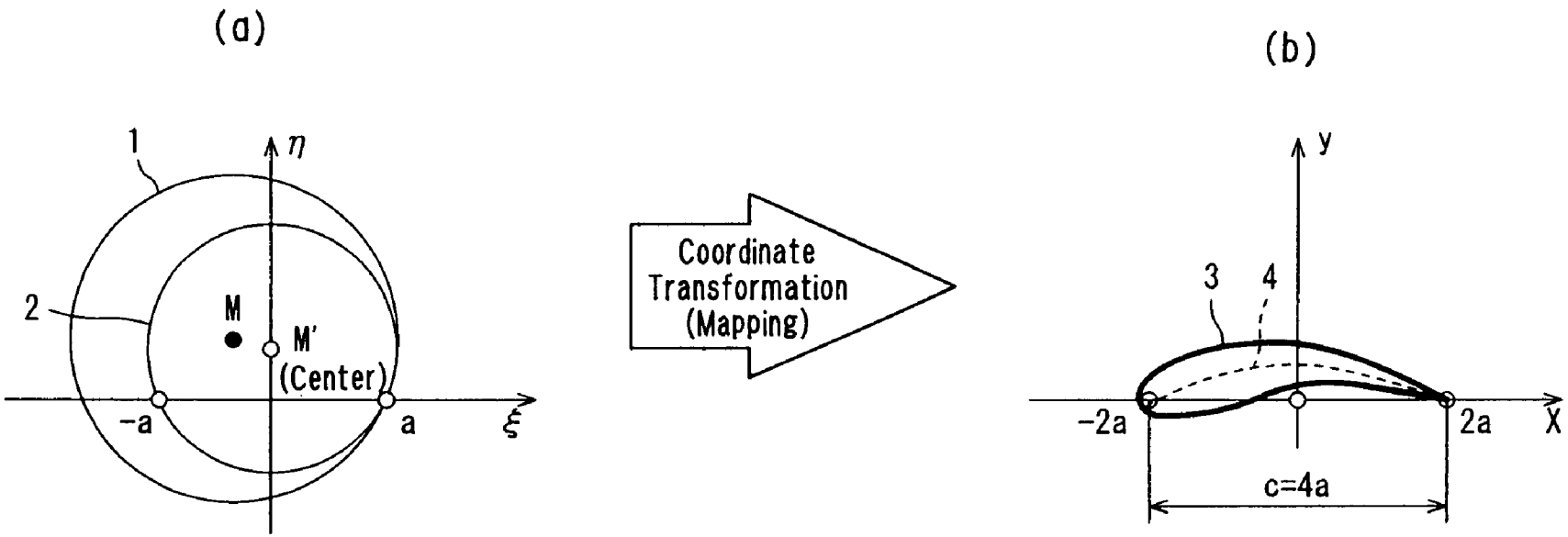
FIG. 10 is an explanation drawing showing a method of drawing a camber line with the use of "Joukowski airfoil".

After the camber line 31 is created (drawn), a blade thickness is added to it, whereby a blade profile (sectional shape of blade) is created (drawn) Such a blade profile is created (drawn) at each of a plurality of locations in the hub diameter direction of the blade. Based on the resulting blade profiles, spline interpolation is performed to create (draw) a spline curve (visible outline of the blade) and a spline surface (exterior surface of the blade), thereby creating (drawing) the entire shape of the blade (external diameter line, external diameter surface). The blade thickness added to the camber line 31 may be a constant thickness over the entire length of the camber line, or may be changed as in the airfoil 3 illustrated in FIG. 10(*b*). With a cooling fan, in particular, the blade thickness is often rendered constant because of easy manufacturing. Particularly in this case, it is important to make full adjustment of the camber line shape by the blade shape creation program P and find an optimal camber line shape.

According to the present embodiment, as described above, under the blade shape creation program P, which creates a blade shape on a space virtually defined by the personal computer 11, the camber line defining equation for defining a camber line to be defined on the blade profile is composed of the first function (cubic function) which defines the leading edge camber line 31A on the leading edge side of the maximum camber point SPM of the camber line 31, and the second function (cubic function) which defines the trailing edge camber line 31B on the trailing edge side of the maximum camber point SPM of the camber line 31. Thus, with the exception of the design factors concerning the maximum camber point at the boundary between the first function and the second function (i.e., position of maximum camber $x_{Tmax}$, maximum camber value $y_{Tmax}$), the design factors on the leading edge side of the camber line 31 and those on the trailing edge side of the camber line 31 can be independently set (changed) by the first function and the second function. Thus, the influence of each design factor on the site of flow can be systematically studied. This facilitates tuning of the site of flow, and enables an airfoil of higher performance to be developed. In connection with the maximum camber point SPM on the boundary between the first function and the second function, it goes without saying that the first function and the second function are equal to each other in terms of the position of maximum camber $x_{Tmax}$ and the maximum camber value $y_{Tmax}$, with their tangents at SPM continuing, and the gradients of the tangents being zero.

In the present embodiment, in particular, the five design factors (chord length L, position of maximum camber $x_{Tmax}$, maximum camber value $y_{Tmax}$, inflow angle $\alpha$, discharge angle $\beta$) were selected as optimal design factors for determining the shape of the camber line 31, and the cubic functions of the equations (2) and (3) were selected as the first function and the second function suited for these design factors. Thus, the respective design factors (chord length L, position of maximum camber $x_{Tmax}$, maximum camber value $y_{Tmax}$, inflow angle $\alpha$, discharge angle $\beta$) can be changed independently of each other. This makes it possible to directly grasp the degree of influence which each design factor (chord length L, position of maximum camber $x_{Tmax}$, maximum camber value $y_{Tmax}$, inflow angle $\alpha$, discharge angle $\beta$) exerts on the performance of the blade (lift performance and drag performance) (i.e., the degree of contribution to blade performance).

For example, FIG. 5 shows an example of the camber line 31 created (drawn), with only the inflow angle $\alpha$ being changed in three different ways. In FIG. 5, only the inflow angle $\alpha$ is changed, and the other design factors (chord length L, position of maximum camber $x_{Tmax}$, maximum camber value $y_{Tmax}$, discharge angle $\beta$) are not changed. Thus, the influence of the inflow angle $\alpha$ on the performance of the blade can be grasped directly. Since each design factor can be changed independently of one another in this manner, the influence of each design factor on the site of flow can be systematically studied. Hence, tuning of the site of flow becomes easy, and an airfoil with higher performance can be developed.

The procedure for deriving the relationships between the respective coefficients ($a_L$, $b_L$, $c_L$, $d_L$, $a_T$, $b_T$, $c_T$, $d_T$) in the cubic functions of the equations (2) and (3) and the design factors (position of maximum camber $x_{Tmax}$, maximum camber value $y_{Tmax}$, inflow angle $\alpha$) will be shown.

First, the relations between the respective coefficients ($a_L$, $b_L$, $c_L$, $d_L$) of the cubic function equation (2) on the leading edge side of the camber line and the design factors are derived in accordance with the following procedure:

From the equation (2) and the constraint (1), $$d_L=0 \tag{12}$$

From the equation (2), $$dy_L/dx_L=3a_Lx_L^2+2b_Lx_L+c_L \tag{13}$$

From the equation (13) and the constrain (5), $$c_L=\tan\alpha \tag{14}$$

From the equation (2) and the constraint (3), the equation (12) and the equation (14), $$y_{Tmax}=a_L\cdot x_{Tmax}^3+b_L\cdot x_{Tmax}^2+x_{Tmax}\cdot\tan\alpha \tag{15}$$

Both sides are multiplied by 2 to give $$2y_{Tmax}=2a_L\cdot x_{Tmax}^3+2b_L\cdot x_{Tmax}^2+2x_{Tmax}\cdot\tan\alpha \tag{16}$$

From the equation (13) and the equation (14), as well as the constraint (7)

$$0=3a_L\cdot x_{Tmax}^2+2b_L\cdot x_{Tmax}+\tan\alpha \tag{17}$$

Both sides are multiplied by $x_{Tmax}$ to obtain $$0=3a_L\cdot x_{Tmax}^3+2b_L\cdot x_{Tmax}^2+x_{Tmax}\cdot\tan\alpha \tag{18}$$

Subtraction of the equation (18) from the equation (16) gives $$\begin{aligned} 2y_{T\max} &= -a_L\cdot x_{T\max}^3+x_{T\max}\cdot\tan\alpha \\ \therefore a_L &= \frac{-2y_{T\max}+x_{T\max}\cdot\tan\alpha}{x_{T\max}^3} \end{aligned} \tag{19}$$

From the equation (15), $$\begin{aligned} b_L &= \frac{y_{T\max}}{x_{T\max}^2}-\frac{\tan\alpha}{x_{T\max}}-a_L\cdot x_{T\max} \\ &= \frac{y_{T\max}}{x_{T\max}^2}-\frac{\tan\alpha}{x_{T\max}}-x_{T\max}\left(\frac{-2y_{T\max}+x_{T\max}\cdot\tan\alpha}{x_{T\max}^3}\right) \end{aligned} \tag{20}$$

Next, the relations between the respective coefficients ($a_T$, $b_T$, $c_T$, $d_T$) of the cubic function equation (3) on the trailing edge side of the camber line and the design factors are derived in accordance with the following procedure:

From the equation (3), $$dy_T/dx_T=3a_Tx_T^2+2b_Tx_T+c_T \tag{21}$$

From the equation (21) and the constraint (6), $$\tan(-\beta)=3a_TL^2+2b_TL+c_T \tag{22}$$

From the equation (21) and the constraint (8), $$0=3a_Tx_{Tmax}^2+2b_Tx_{Tmax}+c_T \tag{23}$$

Subtraction of the equation (23) from the equation (22) gives $$\begin{aligned} \tan(-\beta) &= 3a_T\cdot(L^2-x_{T\max}^2)+2b_T\cdot(L-x_{T\max}) \\ \therefore b_T &= -\frac{3}{2}(L+x_{T\max})\cdot a_T+\frac{\tan(-\beta)}{2(L-x_{T\max})} \end{aligned} \tag{24}$$

From the equation (3) and the constraint (2), $$0=a_TL^3+b_TL^2+c_TL+d_T \tag{25}$$

From the equation (3) and the constraint (4), $$y_{Tmax}=a_Tx_{Tmax}^3+b_Tx_{Tmax}^2+c_Tx_{Tmax}+d_T \tag{26}$$

Subtraction of the equation (26) from the equation (25) gives $$-y_{Tmax}=a_T\cdot(L^3-x_{Tmax}^3)+b_T\cdot(L^2-x_{Tmax}^2)+c_T\cdot(L-x_{Tmax}) \tag{27}$$

Substitution of the equation (24) into the equation (27), followed by arrangement, yields $$\therefore c_T = a_T\cdot\left(\frac{1}{2}L^2+2L\cdot x_{T\max}+\frac{1}{2}x_{T\max}^2\right)-\frac{1}{L-x_{T\max}}\left(\frac{(L+x_{T\max})\cdot\tan(-\beta)}{2}+y_{T\max}\right) \tag{28}$$

Subtraction of (the equation (26)×3) from (the equation (23)×$x_{Tmax}$) gives $$d_T = -\frac{x_{T\max}^2}{3}b_T-\frac{2x_{T\max}}{3}c_T+y_{T\max} \tag{29}$$

Substitution of $b_T$ and $c_T$ into the equation (29), followed by arrangement, yields $$\therefore d_T = \frac{1}{6}(x_{T\max}^3-2x_{T\max}\cdot L^2-5x_{T\max}^2\cdot L)\cdot a_T+\frac{x_{T\max}}{x_{T\max}-L}\left(\frac{x_{T\max}\cdot\tan(-\beta)}{6}-\frac{2}{3}\left(\frac{(L+x_{T\max})\cdot\tan(-\beta)}{2}+y_{T\max}\right)+\frac{x_{T\max}-L}{x_{T\max}}y_{T\max}\right) \tag{30}$$

Substitution of $b_T$, $c_T$ and $d_T$ into the equation (23), followed by arrangement, yields $$\therefore a_T = -\frac{(L-x_{T\max})\cdot\tan(-\beta)+2y_{T\max}}{(x_{T\max}-L)^3} \tag{31}$$

Next, the camber line checking function and the checklist window display function in the blade shape creation program P will be described.

In creating (drawing) the camber line 31 by the blade shape creation program P (cubic functions of the equations (2) and (3)), the following cases may be encountered, depending on a combination of the five design factors (chord length L, position of maximum camber $x_{Tmax}$, maximum camber value $y_{Tmax}$, inflow angle $\alpha$, discharge angle $\beta$) determining the shape of the camber line 31, even if the eight constraints (1) to (8) are fulfilled: There may be a camber line shape, as shown by a camber line 31 illustrated in FIG. 6A, which, at a camber point SP other than a set maximum camber point SPM, has a camber value S greater than a maximum camber value $y_{Tmax}$ at the set maximum camber point SPM. There may be another camber line shape, as shown by a camber line 31 illustrated in FIG. 6B, which, at camber points SP other than the set maximum camber point SPM, has inflection points (there may be a maximum or minimum point).

Under the blade shape creation program P, therefore, a numerical check is made for such cases (i.e., whether a camber value greater than the set maximum camber value is present, and whether a maximum or minimum point or an inflection point is present at a camber point other than the set maximum camber point) at the time of creating the camber line 31. A further check is performed of whether the camber line des not extend beyond the hub. The results of these checks are displayed on the checklist window. A concrete procedure is as follows:

<Method of Checking Whether a Camber Value Greater than a Set Maximum Camber Value is Present>

In the first function (cubic function) and the second function (cubic function) of the camber line defining equation, whose coefficients were determined by setting the design factors (constraints), the camber value S, which is the distance between the chord 32 and the camber line 31, is calculated over the entire region of the camber line 31 in the chordal direction (x-axis direction of FIG. 4). That is, in connection with the cubic function of the equation (2), each coefficient is determined based on the design factors (constrains), and then a camber value $y_L$ at each position (each camber point SP) over the range from $x_L=0$ to $x_L=x_{Tmax}$ is calculated. In connection with the cubic function of the equation (3) as well, each coefficient is determined based on the design factors (constrains), and then a camber value $y_T$ at each position (each camber point SP) over the range from $x_T=x_{Tmax}$ to $x_T=L$ is calculated.

These calculated camber values $y_L$ and $y_T$ are compared with the maximum camber value $y_{Tmax}$ set as a design factor to check whether the camber line has camber values $y_L$ and $y_T$ greater than the maximum camber value $y_{Tmax}$.

<Method of Checking Whether a Maximum, Minimum or Inflection Point Other than a Set Maximum Camber Point is Present>

The first function (cubic function) and the second function (cubic function) of the camber line defining equation, whose coefficients were determined by setting the design factors (constraints), are subjected to differentiation (differentiation of first order, or differentiation of second or higher order). By so doing, whether the camber line 31 has a maximum or minimum point or an inflection point at a position other than the position of maximum camber $x_{Tmax}$ (camber point SP other than the maximum camber point SPM) set as a design factor is checked over the entire region of the camber line 31.

For example, in the first function (cubic function) and the second function (cubic function) of the camber line defining equation, whose coefficients were determined by setting the design factors (constraints), the gradient of the tangent to the camber line 31 ($dy_L/dx_L$, $dy_T/dx_T$) is calculated over the entire region of the camber line 31 in the chordal direction (x-axis direction of FIG. 4). That is, in connection with the cubic function of the equation (2), each coefficient is determined based on the design factors (constrains), and then the gradient of the tangent ($dy_L/dx_L$) at each position (each camber point SP) over the range from $x_L=0$ to $x_L=x_{Tmax}$ is calculated. In connection with the cubic function of the equation (3) as well, each coefficient is determined based on the design factors (constrains), and then the gradient of the tangent ($dy_T/dx_T$) at each position (each camber point SP) over the range from $x_T=x_{Tmax}$ to $x_T=L$ is calculated. Then, a check is made of whether the positivity or negativity of the sign of the calculated gradient of the tangent ($dy_L/dx_L$, $dy_T/dx_T$) is reversed before and after a position other than the set position of maximum camber (camber point SP other than the maximum camber point SPM) (namely, whether there is a maximum or minimum point).

<Method for Checking Whether the Camber Line does not Extend Beyond the Hub>

A check is made of whether the camber line 31, created (drawn) by the camber line defining equation (cubic function), does not extend beyond the hub 22 in a side view (plan view), when its inclination angle with respect to the hub center axis B is also taken into consideration. FIG. 7 shows an example in which a leading edge portion of the camber line 31 to be checked extends beyond the hub 22 in a side view (plan view) of the cooling fan.

<Method for Display of Checklist Window>

The results of the checks made by the above checking methods are displayed on a check list window 16 on a display screen 15 as shown in FIG. 8. Curve-1 to Curve-3 in a column of the checklist window 16 represent camber lines created (drawn) for the blade cross section at each position of the blade in the hub diameter direction. The number of the created camber lines is not limited to 3 in the illustrated example, but may be 2 or 4 or more in accordance with the shape of the blade to be created.

Error-1 to Error-4 in a row of the check list window 16 represent items checked by the above-described checking methods. Error-1 shows the results of the check of whether the camber line 31 as a whole has a camber value greater than the set maximum camber value. When values $y_L$ and $y_T$ greater than the maximum camber value $y_{Tmax}$ are not present, a judgment "no problem" is made, and a circle "○" meaning no problem is displayed. If values $y_L$ and $y_T$ greater than the maximum camber value $y_{Tmax}$ are present, this means that the conditions for setting (preconditions) the maximum camber value and the position of maximum camber are not fulfilled. Since a judgment "problematical" is made, "warning" is displayed.

Error-2 shows the results of the check of whether the leading edge camber line 31A has a maximum or minimum point or an inflection point. When there is no maximum or minimum point or no inflection point, a judgment "no problem" is made, and a circle "○" meaning no problem is displayed. If there is a maximum or minimum point or an inflection point, the presence of a maximum or minimum point or an inflection point on the leading edge side (leading edge camber line 31A) is considered to affect, often adversely, the performance of the blade. Thus, a judgment "problematical" is made, and "warning" is displayed. Error-3 shows the results of the check of whether the trailing edge camber line 31B has a maximum or minimum point or an inflection point. When there is no maximum or minimum point or no inflection point, a judgment "no problem" is made, and a circle "○" meaning no problem is displayed. If there is a maximum or minimum point or an inflection point, "caution" is displayed. The reason why "caution", rather than "warning," is displayed here is that the presence of a maximum or minimum point or an inflection point on the trailing edge side (trailing edge camber line 31B) does not necessarily exert an adverse influence on the performance of the blade, but is rather considered to exert a favorable influence on the performance of the blade. Anyway, a display of "caution" enables the developer to recognize reliably that a maximum or minimum point or an inflection point is present. Error-4 shows the results of the check of whether the camber line 31 does not extend beyond the hub 22. When the camber line 31 does not extend beyond the hub 22, a judgment "no problem" is made, and a circle "○" meaning no problem is displayed. If the camber line 31 extends beyond the hub 22, this is not necessarily a problem, and it suffices to have the developer recognize that the camber line 31 extends beyond the hub 22. Thus, "caution" is displayed.

A "Close" button 42 displayed on the display screen 16 of FIG. 8 is a button to be pushed (for example, to be clicked by a mouse) for closing (erasing) the check list window 16.

According to the present embodiment described above, in the first function (cubic function) and the second function (cubic function) of the camber line defining equation, the camber value S ($y_L$, $y_T$), which is the distance between the chord 32 and the camber line 31, is calculated over the entire region of the camber line 31. This calculated camber value S ($y_L$, $y_T$) is compared with the maximum camber value $y_{Tmax}$ set as a design factor to check whether the camber line 31 has a camber value S ($y_L$, $y_T$) greater than the maximum camber value $y_{Tmax}$. Hence, the presence or absence of a delicate camber value S ($y_L$, $y_T$), which is difficult to confirm visually, can be numerically checked with reliability when creating the camber line 31. Thus, the efficiency of blade development increases. For example, the camber line 31 of FIG. 9B poses no problem about camber values. In regard to the camber line 31 of FIG. 9A, on the other hand, a camber value S ($y_L$) at a camber point SP nearer to the leading edge is slightly larger than a maximum camber value $y_{Tmax}$ at the set maximum camber point SPM. The problem of such a delicate camber value S ($y_L$) can be checked reliably.

According to the present embodiment, moreover, the first function (cubic function) and the second function (cubic function) of the camber line defining equation are differentiated. By so doing, whether the camber line 31 has a maximum or minimum point or an inflection point at a position other than the position of maximum camber set as a design factor is checked over the entire region of the camber line 31. Hence, the presence or absence of a maximum or minimum point or an inflection point, which is difficult to confirm visually, can be numerically checked with reliability when creating the camber line 31. Thus, the efficiency of blade development increases.

According to the present embodiment, moreover, the results of the checks of whether the camber line has a greater camber value than the maximum camber value, whether the camber line has a maximum or minimum point or an inflection point at a camber point other than the maximum camber point, and whether the camber line does not extend beyond the hub are displayed on the checklist window 16. Accordingly, these checking results are clear at a glance, and the efficiency of blade development increases.

While the present invention has been described by the above embodiment, it is to be understood that the invention is not limited thereby, but may be varied or modified in many other ways. In the present embodiment, for example, the personal computer 11 is described as a computer. However, a mainframe computer, such as a supercomputer, or an engineering workstation (EWS) may be used and, as appropriate, can be selected and applied. Such variations or modifications are not to be regarded as a departure from the spirit and scope of the invention, and all such variations and modifications as would be obvious to one skilled in the art are intended to be included within the scope of the appended claims.

What is claimed is:

1. A computer-readable storage medium having computer-executable instructions for generating a blade shape, that when executed performs the method comprising:

defining a camber line on a cross-section of the blade shaped to be generated based on a camber line defining equation having a first cubic function that defines a leading edge camber line on a leading edge side of a maximum camber point on the camber line, and a second cubic function that defines a trailing edge camber line on a trailing edge side of the maximum camber point on the camber line, wherein the first cubic function and the second cubic function take into consideration a chord length, a position of the maximum camber point, a maximum camber value, an inflow angle, and a discharge angle of the camber line as design factors, and the camber line defining equation includes a boundary condition where the first function and the second function have tangents continuous with each other at the maximum camber point; and displaying a checklist window on a display device as to the acceptability of the generated camber line.

2. The computer-readable storage medium according to claim 1 further including instructions for:

calculating a camber value, which is a distance between a chord and the camber line, over an entire region of the camber line with the first cubic function and the second cubic function; and comparing the calculated camber value with the maximum camber value factor to check whether the calculated camber value is larger than the maximum camber value.

3. The computer-readable storage medium according to claim 1 further including instructions for:

checking over an entire region of the camber line to determine whether the camber line has a maximum or minimum point or an inflection point at a position other than the position of the maximum camber point by differentiating the first cubic function and the second cubic function.

4. A computer implemented method of generating a blade shape comprising the steps of:

using the computer to define a camber line on a cross-section of the blade shaped to be generated based on a camber line defining equation having a first cubic function that defines a leading edge camber line on a leading edge side of a maximum camber point on the camber line, and a second cubic function that defines a trailing edge camber line on a trailing edge side of the maximum camber point on the camber line, wherein the first cubic function and the second cubic function take into consideration a chord length, a position of the maximum camber point, a maximum camber value, an inflow angle, and a discharge angle of the camber line-being-taken as design factors, and the camber line defining equation includes a boundary condition where the first cubic function and the second cubic function have tangents continuous with each other at the maximum camber point; and the computer displays a checklist window on a display device regarding the acceptability of the generated camber line.

5. The computer-implemented method of claim 4 further comprising the step of:

calculating a camber value, which is a distance between a chord and the camber line, over an entire region of the camber line with the first cubic function and the second cubic function; and comparing the calculated camber value with the maximum camber value to check whether the calculated camber value is larger than the maximum camber value.

6. The computer implemented method of claim 4 further comprising the step of:

checking over an entire region of the camber line to determine whether the camber line has a maximum or minimum point or an inflection point at a position other than the position of the maximum camber point by differentiating the first cubic function and the second cubic function.

7. A computer-readable storage medium having computer-executable instructions for generating a blade shape, that when executed performs the method comprising:

defining a camber line on a cross-section of the blade shaped to be generated based on a camber line defining equation having a first cubic function that defines a leading edge camber line on a leading edge side of a maximum camber point on the camber line, and a second cubic function that defines a trailing edge camber line on a trailing edge side of the maximum camber point on the camber line, wherein the first cubic function and the second cubic function take into consideration a chord length, a position of the maximum camber point, a maximum camber value, an inflow angle, and a discharge angle of the camber line as design factors, and the camber line defining equation includes a boundary condition where the first cubic function and the second cubic function have tangents continuous with each other at the maximum camber point;

calculating a camber value, which is a distance between a chord and the camber line, over an entire region of the camber line with the first cubic function and the second cubic function;

comparing the calculated camber value with the maximum camber value to determine whether the calculated camber value is larger than the maximum camber value; and displaying on a checklist window of a display device comparison results of whether the calculated camber value is larger than the maximum camber value.

8. A computer-readable storage medium having computer-executable instructions for generating a blade shape, that when executed performs the method comprising:

defining a camber line on a cross-section of the blade shaped to be generated based on a camber line defining equation having a first cubic function that defines a leading edge camber line on a leading edge side of a maximum camber point on the camber line, and a second cubic function that defines a trailing edge camber line on a trailing edge side of the maximum camber point on the camber line, wherein the first cubic function and the second cubic function take into consideration a chord length, a position of the maximum camber point, a maximum camber value, an inflow angle, and a discharge angle of the camber line as design factors, and the camber line defining equation includes a boundary condition where the first cubic function and the second cubic function have tangents continuous with each other at the maximum camber point;

checking over an entire region of the camber line to determine whether the camber line has a maximum or minimum point or an inflection point at a position other than the position of the maximum camber point by differentiating the first cubic function and the second cubic function; and displaying on a checklist window of a display device checking results of whether the camber line has a maximum or minimum point or an inflection point at a position other than the position of the maximum camber point.

9. A computer implemented method of generating a blade shape comprising the steps of:

using the computer to define a camber line on a cross-section of the blade shaped to be generated based on a camber line defining equation having a first cubic function that defines a leading edge camber line on a leading edge side of a maximum camber point on the camber line, and a second cubic function that defines a trailing edge camber line on a trailing edge side of the maximum camber point on the camber line, wherein the first cubic function and the second cubic function take into consideration a chord length, a position of the maximum camber point, a maximum camber value, an inflow angle, and a discharge angle of the camber line taken as design factors, and the camber line defining equation includes a boundary condition where the first cubic function and the second cubic function have tangents continuous with each other at the maximum camber point;

calculating a camber value, which is a distance between a chord and the camber line, over an entire region of the camber line with the first cubic function and the second cubic function;

comparing the calculated camber value with the maximum camber value to determine whether the calculated camber value is larger than the maximum camber value; and using the computer to display on a checklist window of a display device comparison results of whether the calculated camber value is larger than the maximum camber value.

10. A computer implemented method of generating a blade shape comprising the steps of:

using the computer to define a camber line on a cross-section of the blade shaped to be generated based on a camber line defining equation having a first cubic function that defines a leading edge camber line on a leading edge side of a maximum camber point on the camber line, and a second cubic function that defines a trailing edge camber line on a trailing edge side of the maximum camber point on the camber line, wherein the first cubic function and the second cubic function take into consideration a chord length, a position of the maximum camber point, a maximum camber value, an overflow angle, and a discharge angle of the camber line taken as design factors, and the camber line defining equation includes a boundary condition where the first cubic function and the second cubic function have tangents continuous with each other at the maximum camber point;

checking over an entire region of the camber line to determine whether the camber line has a maximum or minimum point or an inflection point at a position other than the position of the maximum camber point by differentiating the first cubic function and the second cubic function, and using the computer to display on a checklist window of a display device checking results of whether the camber line has a maximum or minimum point or a inflection point at a position other than the position of the maximum camber point.

* * * * *